US010197241B2

(12) United States Patent
Sun et al.

(10) Patent No.: US 10,197,241 B2
(45) Date of Patent: Feb. 5, 2019

(54) ILLUMINATING DEVICE AND MANUFACTURING METHOD THEREOF

(71) Applicant: OSRAM GmbH, Munich (DE)

(72) Inventors: Xiaoqing Sun, Shenzhen (CN); Xiongjie Cheng, Shenzhen (CN); Zuzhi Wang, Shenzhen (CN); Canbang Yang, Shenzhen (CN)

(73) Assignee: OSRAM GmbH, Munich (DE)

( * ) Notice: Subject to any disclaimer, the term of this patent is extended or adjusted under 35 U.S.C. 154(b) by 560 days.

(21) Appl. No.: 14/427,996

(22) PCT Filed: Aug. 20, 2013

(86) PCT No.: PCT/EP2013/067327

§ 371 (c)(1),
(2) Date: Mar. 13, 2015

(87) PCT Pub. No.: WO2014/044479

PCT Pub. Date: Mar. 27, 2014

(65) Prior Publication Data

US 2015/0252976 A1 Sep. 10, 2015

(30) Foreign Application Priority Data

Sep. 20, 2012 (CN) ..... 2012 1 0353662

(51) Int. Cl.
*F21V 5/00* (2018.01)
*F21V 15/01* (2006.01)
(Continued)

(52) U.S. Cl.
CPC ..... *F21V 5/004* (2013.01); *F21V 5/002* (2013.01); *F21V 5/007* (2013.01); *F21V 15/01* (2013.01);
(Continued)

(58) Field of Classification Search
CPC ..... F21V 15/01; F21V 17/00; F21V 17/005; F21V 29/70; F21V 31/005; F21V 5/002;
(Continued)

(56) References Cited

U.S. PATENT DOCUMENTS 5,722,759 A * 3/1998 Eklov ..... B60Q 3/30 200/61.5
6,498,356 B1 * 12/2002 Sekiya ..... B41J 2/45 257/113
(Continued)

FOREIGN PATENT DOCUMENTS

CN 101240892 A 8/2008
CN 101430063 A 5/2009
(Continued)

OTHER PUBLICATIONS

English translation of Applicant provided prior art CN103511857.*
(Continued)

*Primary Examiner* — Christopher Stanford
*Assistant Examiner* — Asifa Habib
(74) *Attorney, Agent, or Firm* — Viering Jentschura & Partner MBB

(57) ABSTRACT

Various embodiments may relate to an illuminating device including a lens unit, a housing part and a lighting assembly. The lighting assembly is arranged in a cavity defined by the lens unit and the housing part. The lens unit includes a plurality of micro lens structures, a plurality of locating structures are arranged between the plurality of micro lens structures on one side of the lens unit facing to the lighting assembly, and the locating structures at least partially pass through the lighting assembly to positionally fixed the lighting assembly in relation to the lens unit. Various embodiments may further relate to a method for manufacturing the illuminating device.

12 Claims, 2 Drawing Sheets

(51) Int. Cl.

| | |
|---|---|
| ***F21V 17/00*** | (2006.01) |
| ***F21V 29/70*** | (2015.01) |
| ***F21V 31/00*** | (2006.01) |
| *F21W 131/10* | (2006.01) |
| *F21Y 105/10* | (2016.01) |
| *F21Y 115/10* | (2016.01) |

(52) U.S. Cl.
CPC ..... *F21V 17/00* (2013.01); *F21V 17/005* (2013.01); *F21V 29/70* (2015.01); *F21V 31/005* (2013.01); *F21W 2131/10* (2013.01); *F21Y 2105/10* (2016.08); *F21Y 2115/10* (2016.08); *Y10T 29/49826* (2015.01)

(58) Field of Classification Search
CPC ..... F21V 5/004; F21V 5/007; F21W 2131/10; F21Y 2105/10; F21Y 2115/10; Y10T 29/49826
See application file for complete search history.

(56) References Cited

U.S. PATENT DOCUMENTS

| | | | | |
|---|---|---|---|---|
| 7,588,355 | B1 | 9/2009 | Liu et al. | |
| 2004/0052076 | A1* | 3/2004 | Mueller | F21V 23/0442 362/293 |
| 2007/0058378 | A1* | 3/2007 | Moriyama | F21V 15/01 362/378 |
| 2009/0109677 | A1* | 4/2009 | Coushaine | F21L 4/00 362/267 |
| 2009/0116245 | A1 | 5/2009 | Yamaguchi | |
| 2009/0283779 | A1* | 11/2009 | Negley | F21K 9/00 257/88 |
| 2010/0053961 | A1* | 3/2010 | Mo | H05K 1/0215 362/249.01 |
| 2010/0265284 | A1* | 10/2010 | Satou | G09G 3/003 345/697 |
| 2011/0085329 | A1* | 4/2011 | Kuo | F21V 5/007 362/235 |
| 2011/0194279 | A1* | 8/2011 | Kuo | F21S 2/005 362/235 |
| 2011/0248287 | A1* | 10/2011 | Yuan | H01L 33/60 257/88 |
| 2012/0140472 | A1* | 6/2012 | Naegele | G01J 1/08 362/249.02 |
| 2012/0206673 | A1 | 8/2012 | Ogata et al. | |
| 2012/0242959 | A1* | 9/2012 | Huang | G02B 27/0994 353/20 |
| 2014/0268852 | A1* | 9/2014 | Foley | F21S 48/00 362/520 |
| 2015/0263247 | A1* | 9/2015 | Wada | H01L 33/54 257/98 |
| 2016/0003454 | A1* | 1/2016 | Ye | F21V 27/02 362/268 |
| 2016/0040838 | A1* | 2/2016 | Zaderej | F21V 19/0025 362/249.02 |

FOREIGN PATENT DOCUMENTS

| | | | | |
|---|---|---|---|---|
| CN | 101464596 | A * | 6/2009 | G02F 1/133606 |
| CN | 201688323 | U | 12/2010 | |
| CN | 102182989 | A * | 9/2011 | G02F 1/1336 |
| CN | 102330906 | A | 1/2012 | |
| CN | 102575815 | A | 7/2012 | |
| CN | 202349877 | U | 7/2012 | |
| CN | 103511857 | A | 1/2014 | |
| JP | 2012059579 | A * | 3/2012 | F21S 2/00 |
| WO | 2010052135 | A2 | 5/2010 | |
| WO | 2011053349 | A1 | 5/2011 | |
| WO | 2011140275 | A1 | 11/2011 | |

OTHER PUBLICATIONS

International Search Report based on Application No. PCT/EP2013/067327 (3 Pages) dated Dec. 4, 2013 (Reference Purpose Only).
Chinese Office Action based on Application No. 201210353662.8(12 Pages and 9 pages of English translation) dated Jun. 28, 2016 (Reference Purpose Only).

* cited by examiner

ILLUMINATING DEVICE AND MANUFACTURING METHOD THEREOF

RELATED APPLICATIONS

The present application is a national stage entry according to 35 U.S.C. § 371 of PCT application No.: PCT/EP2013/067327 filed on Aug. 20, 2013, which claims priority from Chinese application No.: 201210353662.8 filed on Sep. 20, 2012, and is incorporated herein by reference in its entirety.

TECHNICAL FIELD

Various embodiments may relate to an illuminating device and a method of manufacturing the illuminating device.

BACKGROUND

Currently, the lens is widely used in illuminating device for realizing various illumination effects and improving illumination efficiency. The lens should be precisely located above a corresponding light source or to cover the light source. In various current illuminating devices, the lens is usually fixed on a circuit board carrying a light source by means of a mechanical fixing element, such as screw or bolt. Especially when a part having a lens structure is used as a housing of the illuminating device, in order not to affect the illumination effect, the lens structure is only arranged in center of the housing, and the lens structure is fixed on the circuit board at an edge region of the housing by means of a mechanical element.

Since only a pressure from the mechanical fixing element is received at the edge region, only the edge region of the housing can be assured to be pressed against the circuit board in such a manner, while a central region might be deformed or warped with respect to the edge region. Such deformed or warped situation is more prominent upon influence of external environment. For instance, an outdoor illuminating device should be subject to certain temperature difference change, for example, a housing made of plastic and having a lens structure expands with heat and contracts with cold as temperature changes. When it expands with heat, although only the edge region of the housing is still fixed on the circuit board, the central region thereof deforms and arches upward with respect to the circuit board. This causes change to a corresponding relation between the lens structure and the light source and therefore will seriously affect the illumination effect of the illuminating device.

SUMMARY

Various embodiments provide an illuminating device, especially for outdoor illuminating devices. The illuminating devices not only have high sealability, but also can keep good illumination effect when subject to environment change.

The illuminating device includes a lens unit, a housing part and a lighting assembly, wherein the lighting assembly is arranged in a cavity defined by the lens unit and the housing part, characterized in that the lens unit includes a plurality of micro lens structures, a plurality of locating structures are arranged between the plurality of micro lens structures on one side of the lens unit facing to the lighting assembly, and the locating structures at least partially pass through the lighting assembly to positionally fixed the lighting assembly in relation to the lens unit. Upon change to a joining position between the lens unit and the lighting assembly, an engagement force therebetween can be uniformly distributed between the micro lens structures that might affect the illumination effect, thereby avoiding a positional change of the micro lens structures with respect to the lighting assembly due to an ununiform local stress.

According to various embodiments, the plurality of locating structures jointly form a stress balanced structure to balance a stress in the lens unit induced by the locating structures. Since the locating structures are formed inside a lens array consisting of the micro lens structures, the engagement force between the lens unit and the lighting assembly also can be distributed, as uniformly as is possible, between the lens array and a corresponding region on the lighting assembly, such as a region where light sources are located.

According to various embodiments, the plurality of locating structures are symmetrically with each other. The plurality of locating structures maybe uniformly distributed on the lens unit. The locating structures can be arranged in pairs at both sides of one or more micro lens structures, and also uniformly distributed surrounding one or more micro lens structures. The more uniformly the locating structures are arranged, the more improvements on anti-warpage performance of the lens unit are made.

According to various embodiments, the locating structures are configured as locating columns.

According to various embodiments, a plurality of locating holes assigned to the locating structures are opened in the lighting assembly, and the locating columns are inserted into the respective locating holes, respectively, for fixed connection with the lighting assembly. Respective locating column and respective locating hole in a position corresponding thereto are plugged together, thereby assuring that various micro lens structures and the light sources corresponding thereto can be positionally fixed.

According to various embodiments, respective locating hole has a first segment facing to the lens unit and a second segment facing to the housing part and the second segment has a larger diameter than the first segment. Preferably, a free end of respective locating column has a stop portion form-fittedly accommodated in the first segment. As a result, respective locating column can be fixed in respective locating hole anti-loosely with the aid of a hot melting process.

According to various embodiments, a plurality of uniformly distributed recesses are formed on one side of the housing part facing to the lighting assembly, and respective stop portion partially extends into respective recess. By means of the locating columns, the lens unit not only can be in fixed connection with the lighting assembly, but also can be further in fixed connection with the housing part to form a "sandwich" structure with the lighting assembly being held between the lens unit and the housing part, moreover, various regions bear substantially a uniform clamping force.

According to various embodiments, an annular sealing member is included, and the sealing member surrounding the lighting assembly is provided in a circumferential joining region of the lens unit and the housing part. Accordingly, the sealability of the illuminating device can be improved.

According to various embodiments, the lighting assembly includes LED chips and a circuit board carrying the LED chips, wherein the locating holes are opened on the circuit board. The plurality of locating holes are uniformly opened on the circuit board, thereby it can be assured that various regions of the circuit board can be engaged with the lens unit under a uniform force.

According to various embodiments, the locating structures and the lens unit are made in one piece. As a result, the manufacturing process of the illuminating device can be simplified, and the number of parts can be reduced.

According to various embodiments, the locating structures are made from a plastic. The plastic can be deformed with heat, thereby, it can be form-fittedly connected together with the locating holes.

According to various embodiments, the housing part is heat sink.

In addition, various embodiments may further relate to a method for manufacturing the illuminating device, including : a) providing a lens unit with a plurality of micro lens structures on one side, and providing a plurality of locating structures between the plurality of micro lens structures; b) providing a lighting assembly with a plurality of locating holes assigned to the locating structures on the lighting assembly; c) inserting respective locating structure into respective locating hole from one side of the lighting assembly having light sources; d) joining the lens unit and the lighting assembly integrally through a hot melting process; and e) providing a housing part that mounted with the lens unit from one side of the lighting assembly facing away from the light sources. The locating structures can be deformed through the hot melting process, thereby, the locating structures can be partially located in the lighting assembly, and various regions of the lens unit can be in fixed connection with the lighting assembly to form an entirety.

According to various embodiments, the plurality of locating structures jointly form a stress balanced structure to balance a stress in the lens unit induced by the locating structures. Preferably, the housing part is a heat sink.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

In the following detailed description, reference is made to the accompanying drawings, which form a part hereof, and in which is shown by way of illustration specific embodiments in which the invention may be practiced. In this regard, directional terminology, such as "top", "bottom", "inner", "outer", is used in reference to the orientation of the figures being described. Because components of embodiments of the present invention can be positioned in a number of different orientations, the directional terminology is used for purposes of illustration and is in no way limiting. It is to be understood that other embodiments may be utilized and structural or logical changes may made without departing from the scope of the present invention. The following detailed description, therefore, is not to be taken in a limiting sense, and the scope of the present invention is defined by the appended claims.

It is to be understood that the features of the various exemplary embodiments described herein may be combined with each other, unless specifically noted otherwise.

Figure 1:
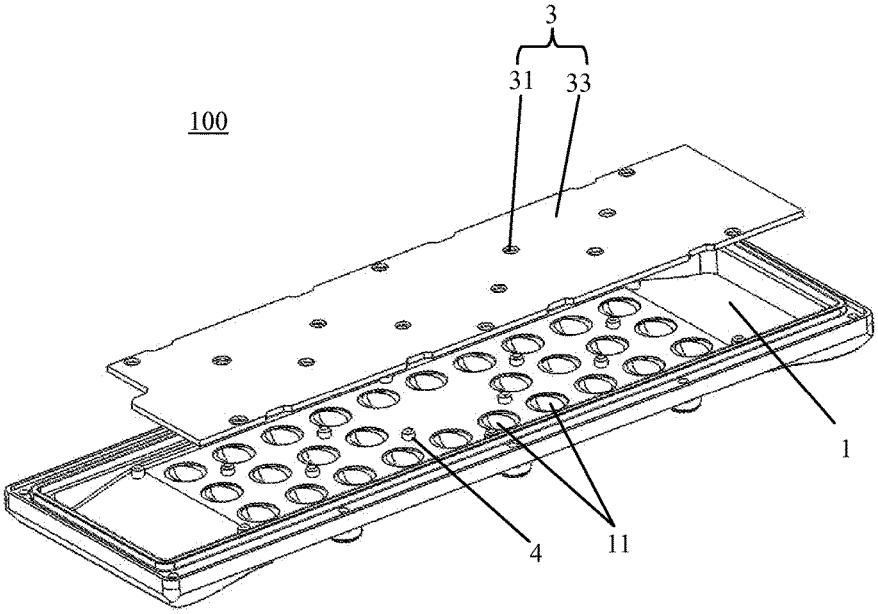
FIG. 1 is an exploded schematic diagram of an illuminating device 100 according to the present disclosure.

FIG. 1 is an exploded schematic diagram of an illuminating device 100 according to the present disclosure. The illuminating device 100 includes a lens unit 1, a lighting assembly 3 and a housing part 2 not shown (see FIG. 2). FIG. 1 shows a positional relation of the illuminating device 100 during assembling in an inverted angle, wherein the housing part 2 not shown is located above the lighting assembly 3 in the figure. The lens unit 1 having a plurality of micro lens structures 11 in a central region herein is used as a first housing of the illuminating device 100, and the housing part 2 not shown and used as a second housing and the lens unit 1 jointly define a cavity R accommodating the lighting assembly 3. The lighting assembly 3 herein includes a circuit board 33 and a plurality of LED chips 32 used as light sources mounted on one side thereof not shown.

In order to prevent the lens unit 1 from being deformed or warped with respect to the circuit board due to an ununiform local stress during an assembling process, or the lens unit 1 from arching towards or away from the circuit board 33, for instance, when expanding with heat and contracting with cold, a plurality of locating structures are particularly provided between the plurality of micro lens structures 11. A plurality of fixed connecting points can be formed between the plurality of micro lens structures 11 and the LED chips 32 on the circuit board 33 with the aid of the locating structures. Thereby, not only positions of the micro lens structures 11 with respect to the LED chips 32 belonging thereto are assured to be fixed, an engagement force between the lens unit 1 and the circuit board 33 is uniformly distributed between the various micro lens structures 11 and the LED chips 32. That is to say, the plurality of locating structures jointly form a stress balanced structure to balance a stress in the lens unit 1 induced by the locating structures.

The locating structures configured as locating columns 4 are distributed between the plurality of micro lens structures 11 symmetrically, especially uniformly, and protrude from one side of the lens unit 1 facing to the circuit board 33. A plurality of locating holes 31 assigned to the locating columns 4 are provided on the circuit board 33. As shown by arrows in the figure, the locating columns 4 are inserted into the locating holes 31 belonging thereto, respectively, so as to fixedly connect the lens unit 1 and the circuit board 33.

Figure 2:
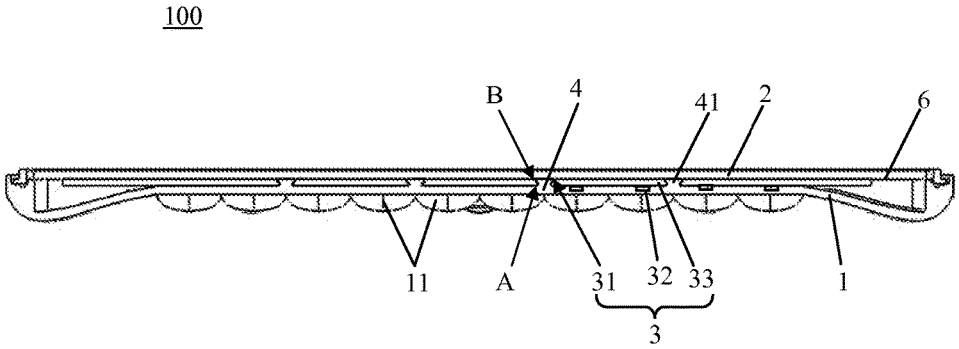
FIG. 2 is a local cross section view of a first embodiment of the illuminating device 100 according to the present disclosure.

FIG. 2 is a local cross section view of a first embodiment of the illuminating device 100 according to the present disclosure. Free ends of two locating columns 4 with an interval of two micro lens structures 11 therebetween extend into the locating holes 31 opened on the circuit board 33, and are even with one side of the circuit board 33 facing away from the LED chips 32.

In order to prevent respective locating column 4 from escaping from respective locating hole 31, respective locating hole 31 is particularly configured into a step shape and has a first segment A facing to the lens unit 1 and a second segment B facing to the housing part 2 and the second segment A has a larger diameter than the first segment B. Correspondingly, a free end of respective locating column 4 is also configured as a stop portion 41 in a step shape and having a diameter increased with respect to a body of the locating column 4. For example, with the aid of a hot melting process, a preform of locating column originally having a columnar profile can be pressed into respective locating hole 31, thereby the stop portion 41 accommodated in the first segment A of the locating hole 31 is formed. In this situation, the plurality of locating holes 31 and the plurality of locating columns 4 form-fitted thereto are fixed together correspondingly one by one to constitute the plurality of stress balanced structures between the lens unit 1 and the lighting assembly 3.

Besides, in order to guarantee good sealability of the illuminating device 100, an annular sealing member 6 is further particularly provided. The sealing member 6 is provided in a circumferential joining region of the lens unit 1 and the housing part 2, and surrounds the lighting assembly 3 therein. Thereby, external pollutants can be prevented from entering the cavity R laterally from the illuminating device 100.

Figure 3:
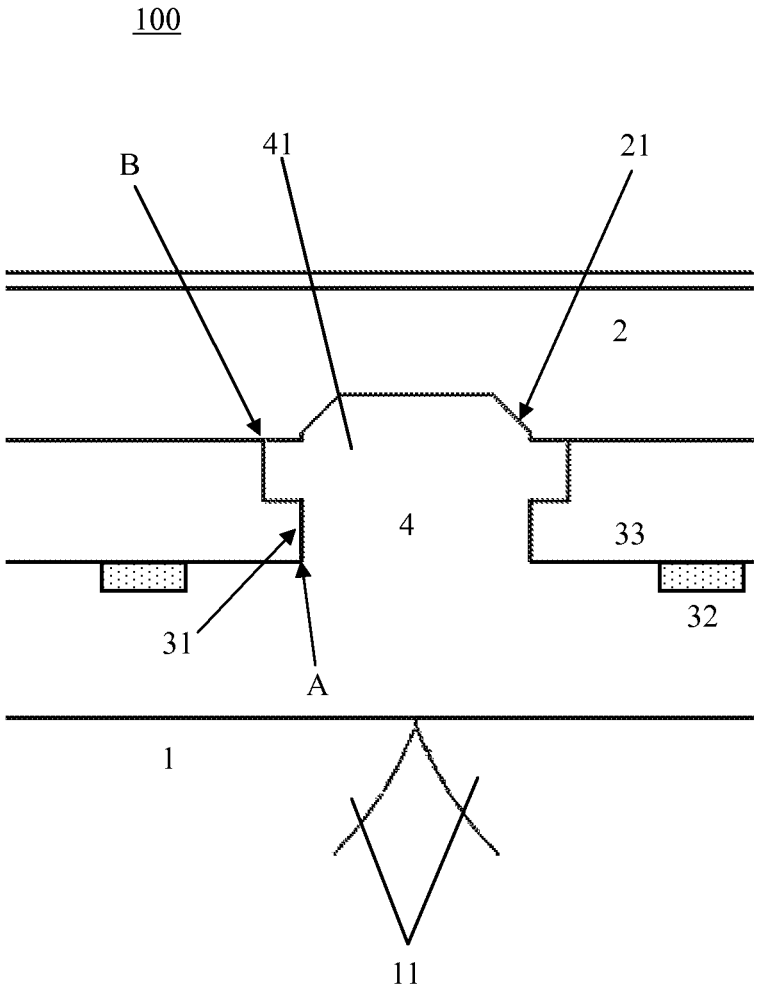
FIG. 3 is an enlarged local diagram of a second embodiment of the illuminating device 100 according to the present disclosure.

FIG. 3 is an enlarged local diagram of a second embodiment of the illuminating device 100 according to the present disclosure. A plurality of uniformly distributed recesses 21 are formed on one side of the housing part 2 facing to the circuit board 33, and respective stop portion 41 partially extends into respective recess 21. The housing part 2, the locating columns 4 and the lens unit 1 can be made from the same material, therefore, during a hot melting treatment, the locating columns 4 extending to pass through the locating holes 31 can form a one-piece part with the housing part 2 and the lens unit 1, with the locating columns 4 held therein. This not only assures the circuit board 33 to be under a clamping force at both sides, and but also uniformly transfer the clamping force to various regions of the circuit board 33 with the aid of the locating columns 4, thereby avoiding a positional change of the micro lens structures 11 with respect to the LED light sources 32 due to an ununiform local stress. The illuminating device 100 also can keep good illumination effect when subject to environment change.

The housing part referred to above embodiments might be a heat sink.

In the present disclosure, the circuit board, for instance, can be various circuit boards, such as MCPCB. In addition, fixing elements can be additionally provided at the edge region of the illuminating device for further fixing the lens unit and the lighting assembly.

In addition, while a particular feature or aspect of an embodiment of the disclosure may have been disclosed with respect to only one of several implementations, such feature or aspect may be combined with one or more other features or aspects of the other implementations as may be desired and advantageous for any given or particular application.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. An illuminating device, comprising:

a lens unit, a housing part and a lighting assembly, wherein the lighting assembly is arranged in a cavity defined by the lens unit and the housing part, wherein the lens unit comprises a plurality of micro lens structures, a plurality of locating structures are arranged between the plurality of micro lens structures on one side of the lens unit facing to the lighting assembly, and the locating structures at least partially pass through the lighting assembly to positionally fix the lighting assembly in relation to the lens unit;

the locating structures are configured as locating columns, a plurality of locating holes assigned to the locating structures are opened in the lighting assembly, and the locating columns are inserted into the respective locating holes, respectively, for fixed connection with the lighting assembly, respective locating hole has a first segment facing to the lens unit and a second segment facing to the housing part and the second segment has a larger diameter than the first segment, a free end of respective locating column has a stop portion form-fittedly accommodated in the first segment;

wherein the locating structures and the lens unit are made in one piece, and wherein the locating structure and lens unit are integrally formed of the same material.

2. The illuminating device according to claim 1, wherein the plurality of locating structures jointly form a stress balanced structure to balance a stress in the lens unit induced by the locating structures.

3. The illuminating device according to claim 2, the plurality of locating structures are symmetrical with each other.

4. The illuminating device according to claim 3, wherein the plurality of locating structures are uniformly distributed on the lens unit.

5. The illuminating device according to claim 1, wherein a plurality of uniformly distributed recesses are formed on one side of the housing part facing to the lighting assembly, and respective stop portion partially extends into respective recess.

6. The illuminating device according to claim 1, further comprising an annular sealing member, wherein the sealing member surrounding the lighting assembly is provided in a circumferential joining region of the lens unit and the housing part.

7. The illuminating device according to claim 1, wherein the lighting assembly comprises LED chips and a circuit board carrying the LED chips, wherein locating holes are opened on the circuit board.

8. The illuminating device according to claim 1, wherein the locating structures are made from a plastic.

9. The illuminating device according to claim 1, wherein the housing part is a heat sink.

10. The illumination device according to claim 1, wherein the locating holes and the locating columns are plugged together.

11. The illuminating device according to claim 10, wherein the locating columns are heat deformable such that the respective locating column is form-fittedly connected with the respective locating hole.

12. The illuminating device according to claim 11, wherein the respective locating column is form-fittedly connected in the respective locating hole with a hot melting process.

* * * * *